US009528486B2

(12) United States Patent
Shore

(10) Patent No.: US 9,528,486 B2
(45) **Date of Patent: *Dec. 27, 2016**

(54) AUTOMOBILE FUEL SYSTEM PRESSURIZATION APPARATUS AND METHOD

(71) Applicant: Ronald J. Shore, Longview, TX (US)

(72) Inventor: Ronald J. Shore, Longview, TX (US)

( * ) Notice: Subject to any disclaimer, the term of this patent is extended or adjusted under 35 U.S.C. 154(b) by 422 days.

This patent is subject to a terminal disclaimer.

(21) Appl. No.: 14/180,828

(22) Filed: Feb. 14, 2014

(65) Prior Publication Data

US 2014/0261337 A1 Sep. 18, 2014

(51) Int. Cl.

| | |
|---|---|
| ***F02N 1/00*** | (2006.01) |
| ***F02M 69/02*** | (2006.01) |
| ***F02M 37/00*** | (2006.01) |
| ***F02M 37/12*** | (2006.01) |
| ***F02M 37/16*** | (2006.01) |

(52) U.S. Cl.

CPC ..... *F02M 69/02* (2013.01); *F02M 37/0082* (2013.01); *F02M 37/12* (2013.01); *F02M 37/16* (2013.01)

(58) Field of Classification Search

CPC ..... F02M 59/42; F02M 37/16; F02M 37/18; F04B 33/00; F04B 37/10

USPC ..... 123/179.11, 179.12, 179.17

See application file for complete search history.

(56) References Cited

U.S. PATENT DOCUMENTS

| | | | | |
|---|---|---|---|---|
| 1,149,661 A | | 8/1915 | McCarthy | |
| 1,248,957 A | | 12/1917 | Voigt | |
| 1,366,180 A | | 1/1921 | Herzmark | |
| 2,956,737 A | | 10/1960 | Hager | |
| 4,428,478 A | | 1/1984 | Hoffman | |
| 4,497,290 A | | 2/1985 | Harris | |
| 5,427,091 A | | 6/1995 | Phillips | |
| 5,738,304 A | * | 4/1998 | Tavano | B64D 37/32 137/67 |
| 6,059,750 A | * | 5/2000 | Fogarty | A61M 1/1068 601/153 |
| 6,345,958 B1 | | 2/2002 | Chen | |

(Continued)

OTHER PUBLICATIONS

International Search Report and Written Opinion issued Apr. 23, 2015 in Int'l Applicaiton No. PCT/US2015/013779.

(Continued)

*Primary Examiner* — John Kwon

(74) *Attorney, Agent, or Firm* — Panitch Schwarze Belisario & Nadel LLP

(57) ABSTRACT

An automobile fuel system pressurization apparatus includes an inflatable bladder having a proximal end, a distal end, an exterior surface, and an inlet accessing an interior. The inflatable bladder being deformable between an expanded state and a deflated state. In the expanded state, the exterior surface of the inflatable bladder is configured to provide an air-tight seal in a filler neck of a fuel tank. A pump is coupled to the inlet of the inflatable bladder and is configured to supply air pressure to the interior of the inflatable bladder. A pressure relief valve is disposed at the distal end of the inflatable bladder and is in fluid communication with the interior of the inflatable bladder. When the inflatable bladder is in the expanded state, the pressure relief valve is configured to release a portion of the air pressure from the interior of the inflatable bladder into the fuel tank.

12 Claims, 4 Drawing Sheets

(56) References Cited

U.S. PATENT DOCUMENTS

| | | | | |
|---|---|---|---|---|
| 9,222,452 | B1 * | 12/2015 | Shore | B60K 15/04 |
| 2010/0326567 | A1 | 12/2010 | McCollom | |

OTHER PUBLICATIONS

Office Action issued Feb. 12, 2015 in U.S. Appl. No. 14/478,181 by Shore.

* cited by examiner

AUTOMOBILE FUEL SYSTEM PRESSURIZATION APPARATUS AND METHOD

BACKGROUND OF THE INVENTION

Embodiments of the present invention relate generally to an apparatus and method for pressurizing an automobile fuel system, and more particularly, to an apparatus and method for pressurizing an automobile fuel system using a pump and bladder system insertable into a filler neck of a fuel tank.

Prior to fuel injection becoming the primary method for admitting fuel to an automotive engine, automobiles were typically equipped with a carburetor and mechanical fuel pump mounted on the engine. Upon initiation of operation of the engine by the starter or while the engine is running, the fuel pump draws fuel (e.g., gasoline) from the fuel tank into a fuel line for use in the carburetor. Under typical operating conditions, the fuel line and pump remain primed such that a subsequent start-up of the engine is accomplished quickly and efficiently.

However, if the automobile remains idle for a period of several weeks or more, or runs out of fuel, the fuel pump and fuel line must be recharged with fuel. In small engine equipment, such as lawn mowers, leaf blowers, or the like, a primer button is provided to feed fuel from the fuel tank to the carburetor prior to actuating the engine. No such configuration is provided for automobile engines. The only way to recharge the fuel pump and fuel line is by running the engine with the starter motor for possibly several minutes or more. This can be difficult, particularly where the automobile has remained idle for an extended period of time, since the battery may not have enough charge to sustain actuation of the starter motor long enough to adequately recharge the fuel system.

It is therefore desirable to provide a fast and simple method of recharging the fuel pump and fuel line in an automobile without having to run the starter motor for an extended period of time.

BRIEF SUMMARY OF THE INVENTION

Briefly stated, an embodiment of the present invention comprises an automobile fuel system pressurization apparatus including an inflatable bladder having a proximal end, a distal end, an exterior surface, and an inlet accessing an interior. The inflatable bladder being deformable between an expanded state and a deflated state. In the expanded state, the exterior surface of the inflatable bladder is configured to provide an air-tight seal in a filler neck of a fuel tank. A pump is coupled to the inlet of the inflatable bladder and is configured to supply compressed air to the interior of the inflatable bladder. A pressure relief valve is disposed at the distal end of the inflatable bladder and is in fluid communication with the interior of the inflatable bladder. When the inflatable bladder is in the expanded state, the pressure relief valve is configured to release a portion of the compressed air from the interior of the inflatable bladder into the fuel tank.

Another embodiment of the present invention comprises a method of pressurizing an automobile fuel tank to prime a fuel pump using an inflatable bladder deformable between an expanded state and a deflated state, a pump coupled to an inlet of the inflatable bladder, and a pressure relief valve at a distal end of the inflatable bladder and in fluid communication with an interior thereof. The method includes inserting the inflatable bladder in the deflated state into a filler neck of the fuel tank. The pump provides a first amount of gas to the interior of the inflatable bladder to deform the inflatable bladder to the expanded state such that an exterior surface of the inflatable bladder forms an air-tight seal in the filler neck of the fuel tank. The pump provides a second amount of compressed air to the interior of the inflatable bladder. The pressure relief valve releases a portion of the first and/or second amount of air from the interior of the inflatable bladder to the fuel tank.

BRIEF DESCRIPTION OF THE DRAWINGS

The foregoing summary, as well as the following detailed description of preferred embodiments of the invention, will be better understood when read in conjunction with the appended drawings. For the purpose of illustration, there are shown in the drawings embodiments which are presently preferred. It should be understood, however, that the invention is not limited to the precise arrangements and instrumentalities shown.

DETAILED DESCRIPTION OF THE INVENTION

Figure 1A:
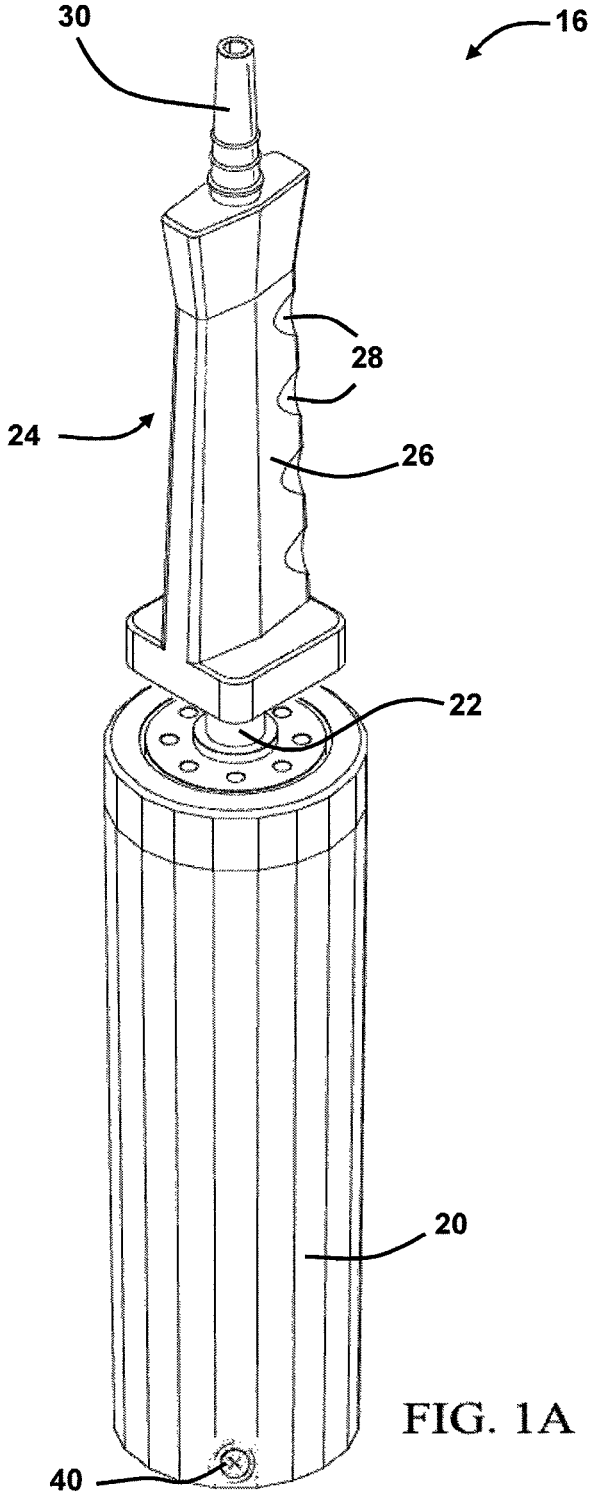
FIG. 1A is a side perspective view of a pump for use as a part of an apparatus in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the apparatus and designated parts thereof. The terminology includes the above-listed words, derivatives thereof, and words of similar import. Additionally, the words "a" and "an", as used in the claims and in the corresponding portions of the specification, mean "at least one."

Figure 1B:
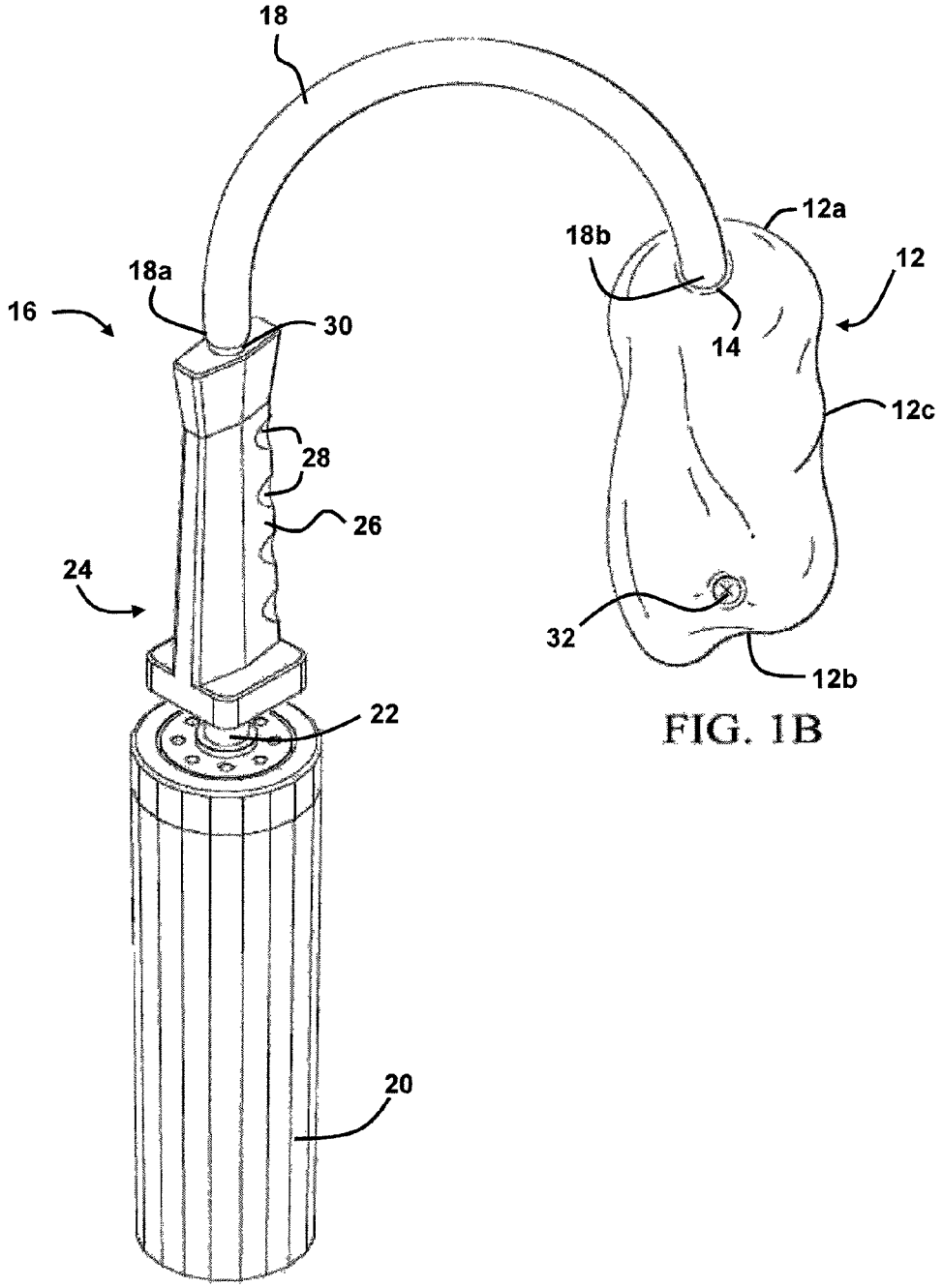
FIG. 1B is a side perspective view of an apparatus according to a preferred embodiment of the present invention.

Referring to the drawings in detail, wherein like reference numerals indicate like elements throughout, there is shown in FIG. 1B an apparatus 10 for pressurizing an automobile fuel system in accordance with a preferred embodiment of the present invention. The apparatus includes an inflatable bladder 12 having a proximal end 12*a* and a distal end 12*b* and an exterior surface 12*c*. The inflatable bladder 12 is preferably formed of rubber. The inflatable bladder 12 further includes a hollow interior (not shown) that is configured to retain air, that may be received through an inlet 14 in fluid communication with the interior of the inflatable bladder 12 and that is preferably disposed at the proximal end 12*a* thereof.

Figure 2:
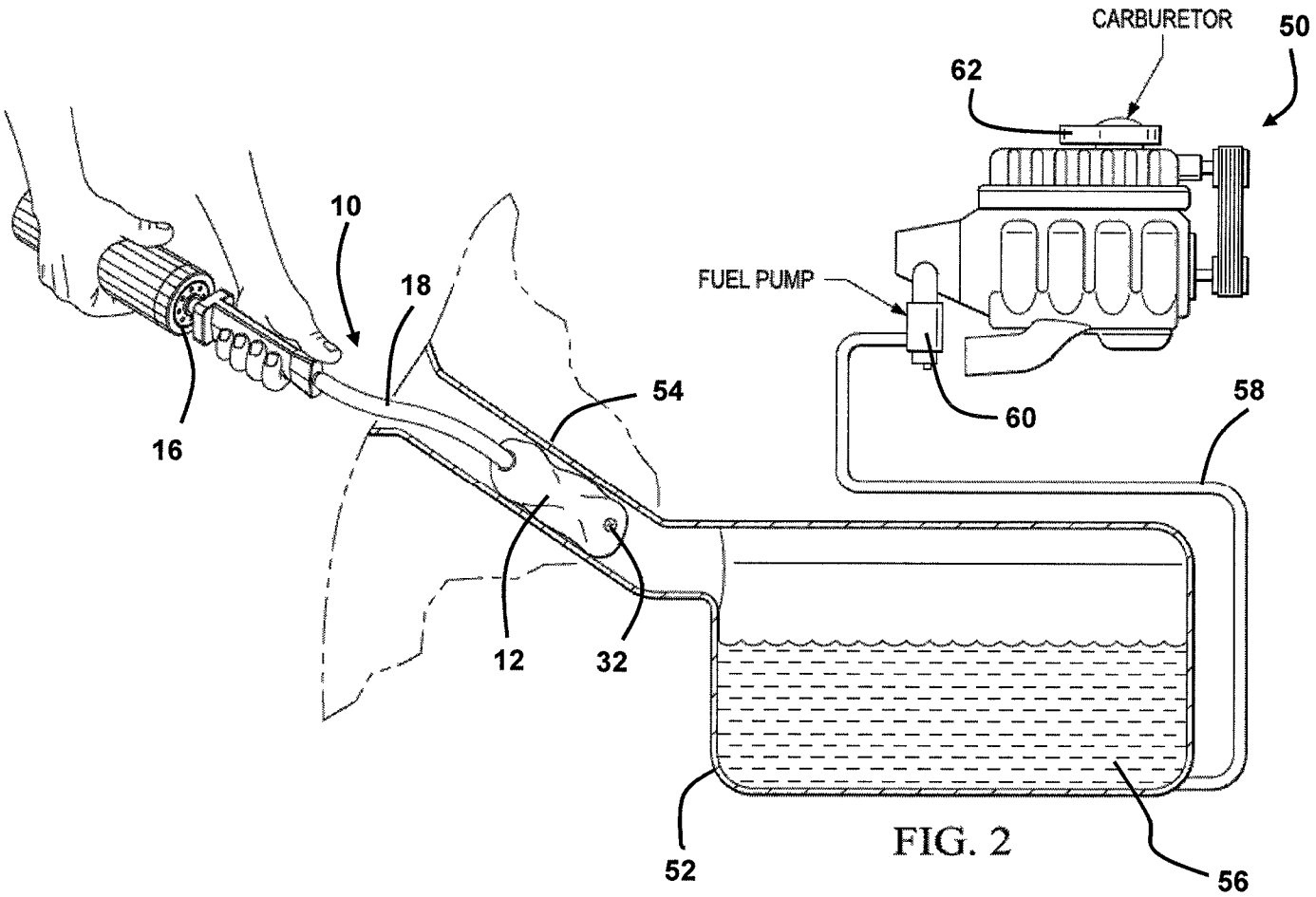
FIG. 2 is a schematic view of the apparatus of FIG. 1B in use with the bladder in a deflated state.
Figure 3:
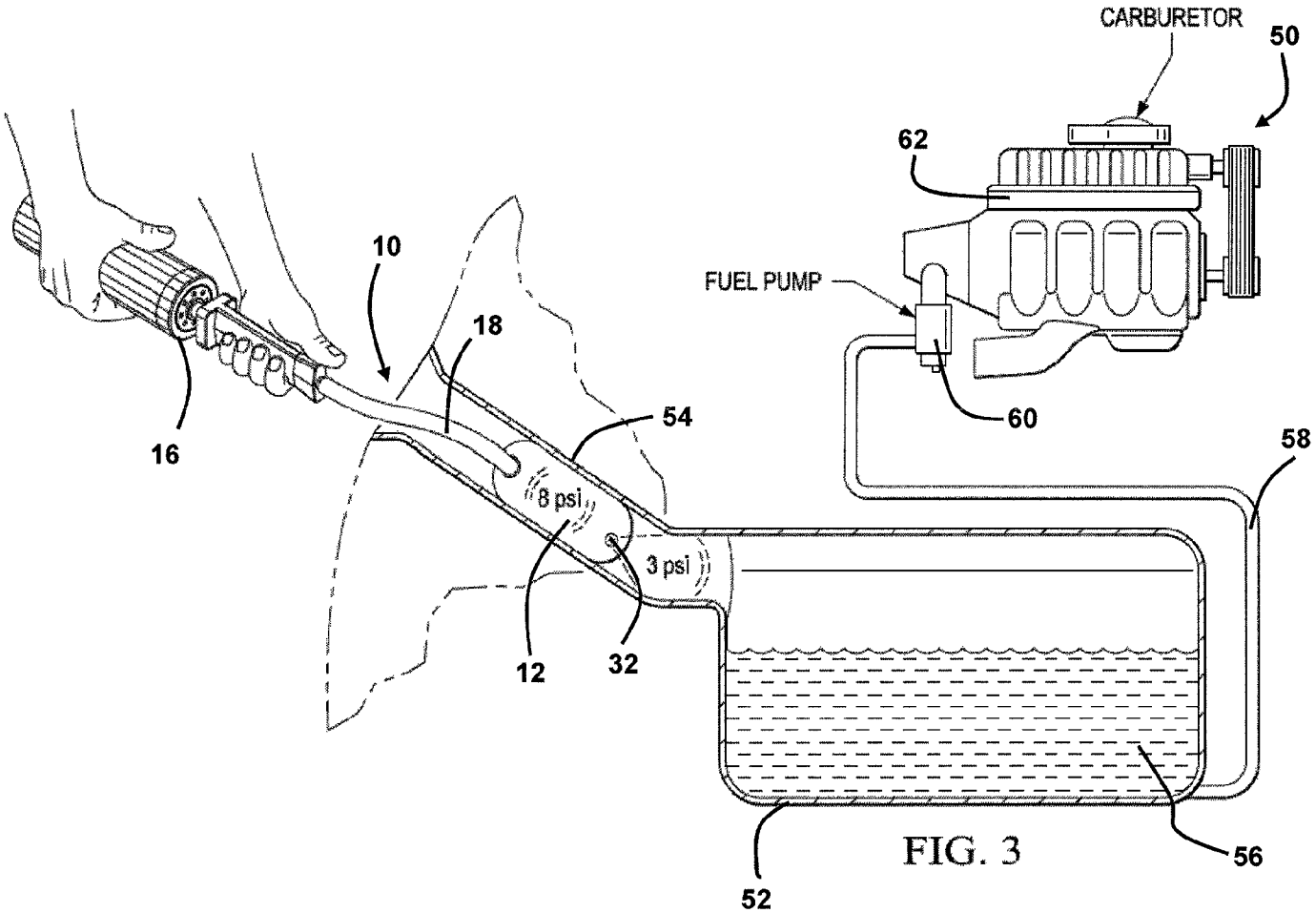
FIG. 3 is a schematic view of the apparatus of FIG. 1B in use with the bladder in an expanded state.

The inflatable bladder 12 is preferably deformable between a deflated state, such as that shown in FIG. 1B, and an expanded state (see e.g., FIG. 3). In the deflated state, there is little air contained within the inflatable bladder 12 and the exterior surface 12*c* thereof is generally formless (i.e., the exterior surface 12*c* does not define a definite shape and is easily stretched, bent, twisted, manipulated, or the like). FIG. 2 schematically shows at least a portion of a fuel system 50 of an automobile, which includes a fuel tank 52 and a filler neck 54 in fluid communication therewith for delivery of fuel 56 from an external source (not shown). In the deflated state, the inflatable bladder 12 is insertable at least partially into the filler neck 54.

In the expanded state, the exterior surface 12*c* of the inflatable bladder 12 is pulled taut by the pressure of air contained in the interior of the inflatable bladder 12, and preferably is spherical or ovoid in shape when unconstrained. A maximum outer diameter, measured generally perpendicularly to an axis of insertion to the filler neck 54, of the exterior surface 12*c* of the inflatable bladder 12 in the expanded state is preferably slightly larger than an inner diameter of the filler neck 54 of the automobile fuel system. Accordingly, when the inflatable bladder 12 is in the expanded state and disposed within the filler neck 54 as shown in FIG. 3, the exterior surface 12*c* of the inflatable bladder 12 may contact and fit tightly to a contour of the inner wall of the filler neck 54 to create an air-tight seal to cut off the fuel tank 52 from the external environment.

A pump 16 is provided for supplying compressed air to the interior of the inflatable bladder 12. The pump 16 is preferably of a manually operated type, since there is a danger of an electrical or motorized pump over-inflating and damaging the inflatable bladder 12 and/or the fuel tank 52. One preferred type of pump 16 shown in FIGS. 1A-3 is a handheld piston-type pump. This type of pump is advantageous in that it is lightweight and portable, and is unlikely to over-pressurize the inflatable bladder 12. As shown in the drawings, the pump 16 preferably includes a hollow cylinder 20 housing an axially movable piston rod 22 coupled to a hand grip 24. The hand grip 24 may have a hand gripping surface 26 with a plurality of finger slots or grooves 28 formed therein to receive the fingers of the user's hand, which enables a better grip on the pump 16 to ease the manual actuation of the piston rod 22 within the cylinder 20. At an end of the hand grip 24 opposite to the piston rod 22 is an outlet 30 in fluid communication with an interior of the cylinder 20. As the piston rod 22 is retracted into the cylinder 20, compressed air is forced out of the cylinder 20 through the outlet 30.

Although the pump 16 shown in the drawings and described above is of a particular design, other types of pumps 16 may be used as well. For example, other manual piston type pumps, such as a bicycle pump or the like, may be used. Rubber bulb-type manual pumps may also be used. In its broadest sense, the invention is not limited by the type of pump 16 utilized to provide gas to the inflatable bladder 12.

The pump 16 is preferably coupled to the inlet 14 of the inflatable bladder 12 by a flexible hose 18, although other methods of coupling may also be used. The flexible hose 18 has a first end 18*a* that is coupled to the outlet 30 of the pump 16 and a second end 18*b* that is coupled to the inlet 14 of the inflatable bladder 12. The flexible hose 18 is preferably detachable from one or both of the pump 16 and inflatable bladder 12. For example, in FIG. 1B, the flexible hose 18 is integrally formed with or fixedly attached to the inlet 14 of the inflatable bladder 12, but the first end 18*a* of the flexible hose 18 is detachable from the outlet of the pump 16. However, it is also contemplated that the flexible hose 18 may be permanently affixed to or integrally formed with both the pump 16 and inflatable bladder 12. The flexible hose 18 is preferably about twelve inches in length and about ¼ inch in diameter. In a preferred embodiment, the pump 16 and the inflatable bladder 12 each include a ¼ inch barbed hose fitting (not shown) for connection to the flexible hose 18.

A pressure relief valve 32 is disposed at the distal end 12*b* of the inflatable bladder 12 and is in fluid communication with the interior thereof. When the inflatable bladder 12 is in the expanded state and the interior thereof is driven beyond a predetermined pressure, the pressure relief valve 32 is configured to release a portion of the compressed air stored in the inflatable bladder 12 into the fuel tank 52. The addition of air pressure to the fuel tank 52 forces fuel 56 into a fuel line 58 toward a fuel pump 60 coupled to a carburetor 62 at the engine (not shown). Thus, it is the air pressure released by the pressure relief valve 32 on the inflatable bladder 12 that primes the automobile fuel system 50 with fuel 56.

An exemplary process for using the apparatus 10 will now be described with reference to FIGS. 2 and 3. The first end 18*a* of the flexible hose 18 is preferably coupled to the outlet 30 of the pump 16, and the inflatable bladder 12, in the deflated state, is inserted into the filler neck 54 of the fuel tank 52. It should be noted that connection of the flexible hose 18 to the pump 16 may be made after insertion of the inflatable bladder 12 into the filler neck 54, if desired. Of course, in embodiments where the flexible hose 18 and the pump 16 are integrally or fixedly connected, no prior attachment is necessary.

Grasping the cylinder 20 of the pump 16 in one hand and the grip portion 24 in the other hand, the user alternately withdraws and retracts the piston rod 22 in the cylinder 20 to supply a first amount of compressed air to the interior of the inflatable bladder 12 to reach the expanded state (FIG. 3), thereby sealing the filler neck 54. As additional air pressure is added by the pump 16 to the interior of the inflatable bladder 12, pressure inside of the inflatable bladder 12 is increased, thereby triggering the pressure relief valve 32 to release some of the compressed air into the fuel tank 52.

When an adequate amount of fuel 56 has been received in the fuel line 58 to prime the fuel pump 60, and fill the float bowl of the carburetor, the inflatable bladder 12 may be allowed to vent at least some of the gas remaining in the interior thereof in order to return to the deflated state to enable withdrawal of the inflatable bladder 12 from the filler neck 54. This may be accomplished, for example, by detaching the pump 16 from the first end of the flexible hose 18. Venting preferably occurs either just before or after the engine is started. The compressed air in the inflatable bladder 12 can then pass through the flexible hose 18 and vent to atmosphere, thus collapsing the exterior surface 12*c* of the inflatable bladder 12. In embodiments where the flexible hose 18 cannot be detached from the pump 16, the pump 16 may be provided with a release valve (not shown) that can be selectively actuated upon completion of the pressurizing process.

As a safety precaution, in the event the pump 16 is capable of producing a sufficient amount of pressure to threaten damage to the inflatable bladder 12 and/or the fuel tank 52, the pump 16, or some other portion of the apparatus 10 may be provided with a safety relief valve 40 to vent excess air pressure to atmosphere and maintain a safe pressure within the inflatable bladder 12 and fuel tank 52.

It will be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

I claim:

1. An automobile fuel system pressurization apparatus comprising:

an inflatable bladder having a proximal end, a distal end, an exterior surface, and an inlet accessing an interior, the inflatable bladder being deformable between an expanded state and a deflated state, wherein in the expanded state the exterior surface of the inflatable bladder is configured to provide an air-tight seal in a filler neck of a fuel tank;

a pump coupled to the inlet of the inflatable bladder and being configured to supply air pressure to the interior of the inflatable bladder; and a pressure relief valve disposed at the distal end of the inflatable bladder and in fluid communication with the interior of the inflatable bladder, wherein when the inflatable bladder is in the expanded state, the pressure relief valve is configured to release a portion of the air pressure from the interior of the inflatable bladder into the fuel tank.

2. The apparatus of claim 1, wherein the pump is a manual pump.

3. The apparatus of claim 2, wherein the pump is a hand-held piston pump.

4. The apparatus of claim 3, wherein the hand-held piston pump has a hand gripping surface contoured to receive fingers of a user's hand.

5. The apparatus of claim 1, further comprising a flexible hose having a first end coupled to an outlet of the pump and a second end coupled to the inlet of the inflatable bladder.

6. The apparatus of claim 5, wherein the flexible hose is detachably coupled to one or both of the pump and the inflatable bladder.

7. The apparatus of claim 1, wherein the pump includes a safety relief valve.

8. The apparatus of claim 1, wherein the inflatable bladder is configured to remain in the expanded state during release of compressed air by the pressure relief valve into the fuel tank.

9. A method of pressurizing an automobile fuel tank to prime a fuel pump using an inflatable bladder deformable between an expanded state and a deflated state, a pump coupled to an inlet of the inflatable bladder, and a pressure relief valve at a distal end of the inflatable bladder and in fluid communication with an interior thereof, the method comprising:

inserting the inflatable bladder in the deflated state into a filler neck of the fuel tank;

providing, by the pump, a first amount of compressed air to the interior of the inflatable bladder to deform the inflatable bladder to the expanded state such that an exterior surface of the inflatable bladder to provide an air-tight seal in the filler neck of the fuel tank;

providing, by the pump, a second amount of air pressure to the interior of the inflatable bladder; and releasing, by the pressure relief valve, a portion of the first and/or second amount of air pressure from the interior of the inflatable bladder to the fuel tank.

10. The method of claim 9, further comprising disconnecting the pump from the inlet of the inflatable bladder to allow the inflatable bladder to return to the deflated state.

11. The method of claim 9, wherein the first amount of air pressure is greater than the second amount of air pressure.

12. The method of claim 9, wherein the pump is a manual pump, and the steps of providing the first and second amounts of air pressure include manually actuating the pump.

* * * * *